United States Patent [19]

Gilhaus

[11] Patent Number: 4,924,556

[45] Date of Patent: May 15, 1990

[54] STRETCH-BREAK MACHINE WITH DRAFTING AND BREAKING ZONES IN SUPERIMPOSED LEVELS

[75] Inventor: Konrad Gilhaus, Bielefeld, Fed. Rep. of Germany

[73] Assignee: Seydel Vermögensverwaltungsgesellschaft mit beschränkter Haftung, Bielefeld, Fed. Rep. of Germany

[21] Appl. No.: 184,973

[22] Filed: Apr. 22, 1988

[30] Foreign Application Priority Data

May 19, 1987 [EP] European Pat. Off. ..... 087107252.6

[51] Int. Cl.[5] ..... D01G 1/08

[52] U.S. Cl. ..... 19/0.35; 19/243

[58] Field of Search ..... 19/0.3, 0.35, 0.37, 19/0.39, 0.41, 0.43, 0.46, 0.48, 0.51, 0.56, 145.5, 242, 243

[56] References Cited

U.S. PATENT DOCUMENTS

| | | | |
|---|---|---|---|
| 2,746,091 | 5/1956 | Tissot et al. | 19/0.41 |
| 3,377,663 | 4/1968 | Arai et al. | 19/0.41 |
| 3,503,100 | 3/1970 | Glynn | 19/0.46 |
| 4,112,548 | 9/1978 | Sauvage | 19/243 |
| 4,369,622 | 1/1983 | Teed et al. | 19/243 |

FOREIGN PATENT DOCUMENTS 757025 12/1933 France .

*Primary Examiner*—Andrew M. Falik

*Attorney, Agent, or Firm*—Robert W. Becker & Associates

[57] ABSTRACT

A machine for stretch-break converting man-made fibers or fiber slivers, with the machine having one or more distortion zones, one of which can be embodied as a heating zone, and one or more breaking zones, whereby the distortion and breaking zones can be disposed in several superimposed levels. The machine also has a tow-drafting mechanism, as well as a delivery mechanism for stretch-break converted fiber slivers. So that tows having a greater overall weight can be processed, the drafting mechanism is spread out such that a plurality of separate tows can be individually guided parallel to and independently of one another next to and/or above one another. The width of the components of the distortion and breaking zones is greater than 270 mm.

19 Claims, 6 Drawing Sheets

STRETCH-BREAK MACHINE WITH DRAFTING AND BREAKING ZONES IN SUPERIMPOSED LEVELS

BACKGROUND OF THE INVENTION

The present invention relates to a machine for stretch-break converting man-made fibers or fiber slivers, with the machine having one or more distortion zones, one of which can be embodied as a heating zone, and one or more breaking zones, whereby the distortion and breaking zones can be disposed in several superimposed levels. The machine also has a tow-drafting mechanism, as well as a delivery mechanism for the stretch-break converted fiber slivers.

Staple fibers or filament threads of man-made fibers are primarily pressed out of spinnerets as endless filaments or tows. Especially for the manufacture of short staple threads in the so-called cotton spinning mills, the manufacturer of the man-made fibers cuts the filaments to finite lengths of, for example, 40 mm, and then packages them into bales. Finally, these bales are delivered to the textile mill, where the loose, irregular threads are organized into fiber slivers via bale openers, carding or crimping, and drawing, and are supplied to the spinning machines to produce threads or yards. This traditional process that is aligned with the preparation of cotton and wool is not suitable for longer fine fibers due to reasons of quality.

The use of cut-converting machines, where the filament tow delivered by the manufacturer of man-made fibers is converted between cutting elements into fiber piles of a defined length, and is subsequently combined to form slivers, is limited for quality reasons to specific raw materials and coarser fibers.

In the stretch-break converting process, the finite filament tows that have already been produced by the manufacturer of man-made fibers are broken by being stretched in stages. In so doing, the cohesion of the sliver is not affected, nor is the excellent parallel nature of the fibers of the tow. Knotting and snarling of the fibers is avoided. The high quality of the slivers produced by stretch-break conversion has, in addition to the possibility of being able to utilized the fiber shrinkage that results from the stretching of the fibers, especially with polyacrylic fibers, in an efficient manner to produce particularly bulky threads or yarns, also contributed to the further expansion of the stretch-break conversion process.

Machines for stretch-break conversion are known, for example, from German Offenlegungsschrift 34 00 949 Kampen dated Jul. 25, 1985 belonging to the assignee of the present invention, and include, in the feed direction, one after the other, various distortion and breaking zones for stretching and breaking the fibers. In so doing, the fiber material is broken to the desired length and to the fiber length distribution required for the subsequent process. In addition, heating zones are provided to increase the fiber shrinkage. Via a drafting frame, the filament tow that is delivered from the manufacturer of the man-made fiber in cartons or bales is fed into the stretch-break machine. A delivery mechanism deposits the stretch-break converted fiber slivers into canisters. Since in the subsequent process fiber slivers that are both capable of shrinking and are already preshrunk are frequently combined, the possibility exists to treat the fiber slivers prior to the time that they are deposited into the canisters either by cooling the slivers to preserve the shrinkage, or by continuously subjecting the slivers to a saturated-steam treatment to eliminate the shrinkage. In order to save space, with the heretofore known stretch-break conversion machines the processing sequence is undertaken in several levels in a space-saving manner.

The heretofore known stretch-break converting machine is in a position to reliably process polyacrylic tow having filament deniers of 3.3 dtex up to an overall quantity weight of 120 ktex. Greater tow weights can be processed only by using coarser filament deniers. However, since coarser filament deniers have only limited applications, the heretofore known stretch-break converting machine is generally not usable for processing greater tow weights. Unfortunately, this prevents economic efforts in the man-made fiber industry to increase the tow weights. Especially in the production of polyacrylic nitrile filament tows pursuant to the wet-spinning process, the plants, with relatively low capital outlay, can be converted to the more economical delivery of greater tow weights.

Other known art of interest includes:

FR-PS 2 301 612
US-PS 4 369 622
GB-PS 1 016 860
BE-PS 893 914
US-PS 3 066 357
FR-PS 1 277 010
FR-PS 757 025

BRIEF SUMMARY OF THE INVENTION

It is therefore an object of the present invention to further develop a machine of the aforementioned general type for stretch-break converting man-made fiber tows or slivers in such a way that tows having a greater overall weight can be processed, so that there would be the possibility of simultaneously processing a plurality of tows of lesser weight.

The general structure and arrangement of the components of the inventive stretch-break machine includes distortion and breaking zones disposed in two superimposed levels with tow guidance in the adjacent levels oppositely directed. The tow is fed to the upper level, where a distortion zone I is disposed, whereas in the lower level breaking zones II to V are disposed, resulting in an extremely compact machine configuration. A tow-drafting mechanism is provided with the stretch-break machine as a preliminary distortion zone with multiple deflection of the tow, and a three-high mill of rollers having an omega-shaped loop-around and having two driven lower cylinders as well as an upper pressure roller disposed after the tow-drafting mechanism.

To achieve a constant, jerk-free operation when the machine is started as well as during normal operation, it is advantageous, for the purpose of deflecting the tow from the upper level to the lower level, to guide the tow via a feed group that is disposed either in the lower level or in the upper level, and that comprises two drive cylinders and a pressure roller, with the pressure roller being hydraulically loaded and cooperating with only one of the two drive cylinders. By disposing the pressure roller above the working cylinders and by using only two working cylinders, a particularly compact arrangement is achieved.

In principle, the tow-drafting mechanism of the inventive stretch-break machine can be fed from any desired direction, although for reasons of space, it is advantageous to dispose on the machine, i.e. above the levels, a drafting frame for feeding the tow in a direction opposite to the tow feed of the uppermost level. For this purpose, a drafting frame can be provided at the beginning of a feed path with a tow-guiding mechanism with which a plurality of separate tows can be individually guided independently of one another next to and/or above one another, and can be fed to the distortion and breaking zones.

The tow-guiding mechanism includes individual curved guide members that extend transverse to the feed direction of the tow, and that each form, for the tow, a guide bed that is delimited at the sides by the bends of the guide member. It is readily possible to integrate such a tow-guiding mechanism into conventional stretch-break converting machines without requiring an additional capital outlay, and without thereby sacrificing the compactness of the heretofore known stretch-breaking converting machines.

The curved guide members are preferably disposed in such a way that they can be shifted transverse to the feed direction of the tow. In this way, the tow-guiding mechanism can be optimally adapted to the requirements at any given moment, so that, for example, instead of guiding the tows next to one another, after shifting the curved guide members the tows can be guided above one another.

Also, prior to or upstream of the curved members, the tows can be deflected or guided about guide bars that are common to all of the tows. In cooperation with the curve guide members, an optimum guidance of the tows is provided, with common guide bars generating a tension in the tows that has a positive effect upon the character of the guidance. The common guide bars preferably have a polygonal cross-sectional shape, which can, for example, be triangular, quadratic, or hexagonal.

Downstream of the tow-guiding mechanism, on the drafting frame, at least one pair of guide members is disposed, with one guide member thereof being curved and forming, for the tows, a guide bed that is delimited at the sides by the bends of the guide member, and that combines the tows next to and/or above one another. Via the pair of guide members, it is possible to guide the tows in a planar fashion next to or above one another, and in so doing to further spread them.

BRIEF DESCRIPTION OF THE DRAWINGS

This object, and other objects and advantages of the present invention, will appear more clearly from the following specification in conjunction with the accompanying schematic drawings, in which.

DESCRIPTION OF PREFERRED EMBODIMENTS

Figure 1:
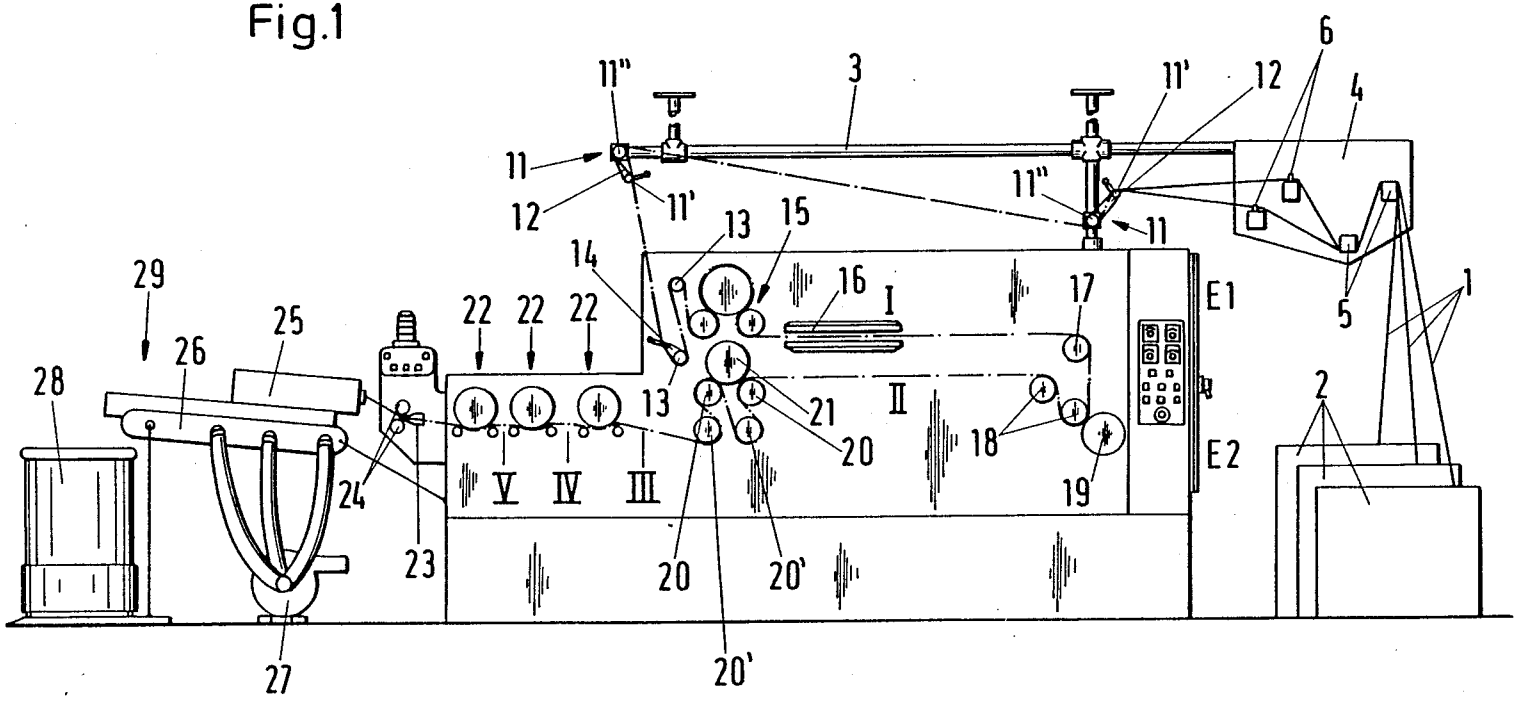
FIG. 1 is a side view of a first exemplary embodiment of the inventive stretch-break machine with a drafting frame that includes a tow-guiding mechanism.

Referring now to the drawings in detail, the machine illustrated in FIG. 1 serves for the stretch-break conversion of (fiber) tows 1, which are delivered in bales 2 from the manufacturer of the man-made fibers, and which are withdrawn from these bales. In the embodiment illustrated in FIG. 1, three tows 1 are withdrawn from a total of three bales 2 and are fed to a drafting frame 3 that is suspended at the top above the actual machine.

At the beginning of the feed path of the tow 1, the drafting frame 3 is provided with a tow-guiding mechanism 4. The details of this mechanism 4 are illustrated on an enlarged scale in FIGS. 3 and 4.

Figure 4:
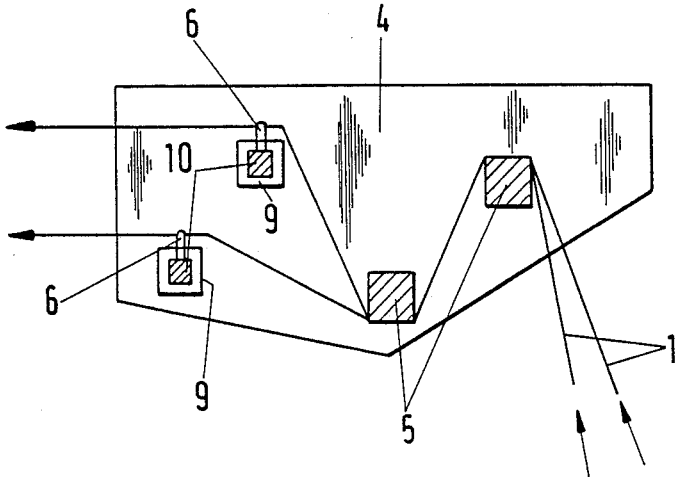
FIG. 4 is a cross-sectional view through the tow-guiding mechanism taken along the line IV—IV in FIG. 3.
Figure 5:
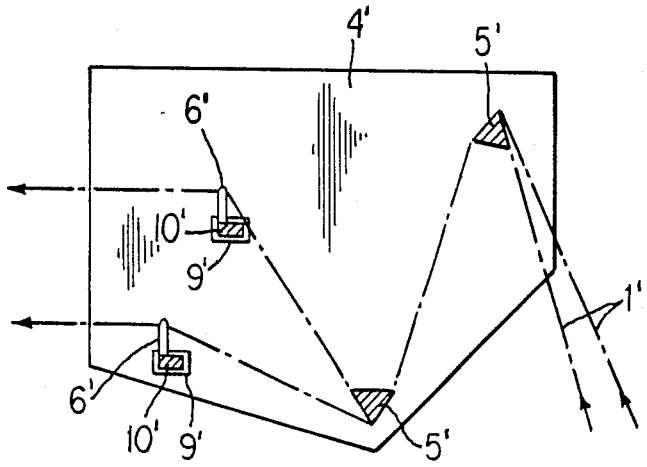
FIG. 5 is a cross-sectional view similar to that of FIG. 4 and showing guide bars that have a triangular shape.
Figure 6:
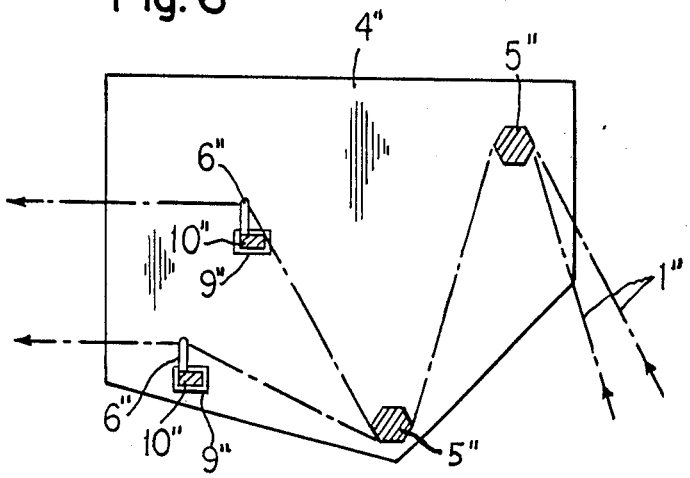
FIG. 6 is a cross-sectional view similar to that of FIG. 4 and showing guide bars that have a hexagonal shape.
Figure 7:
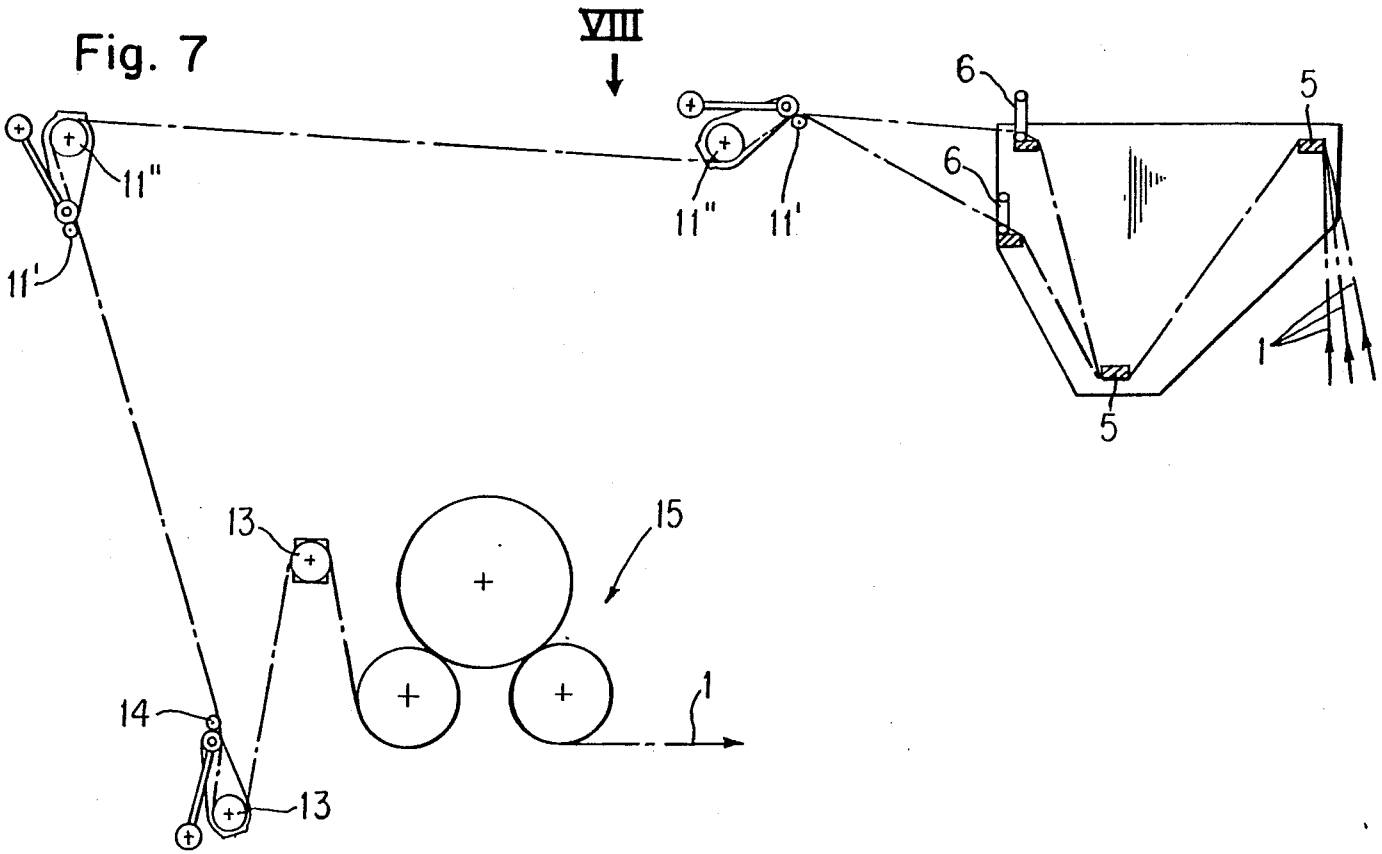
FIG. 7 is an elevational plan view of the tow guiding mechanism.
Figure 8:
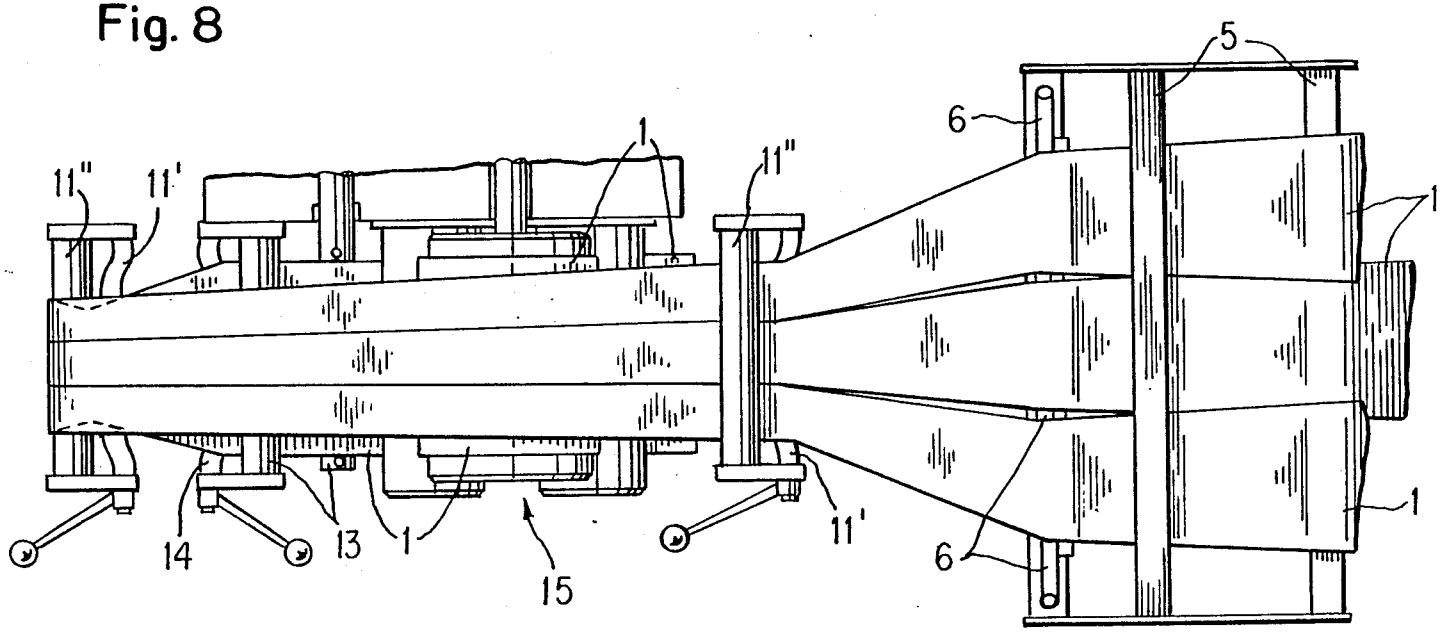
FIG. 8 is a top plan view of the tow guiding mechanism taken in the direction of arrow VIII in FIG. 7.

FIG. 5 is a view similar to that of FIG. 4 and showing guide bars having triangular shape with primes added to reference numerals. FIG. 6 is a view similar to that of FIG. 4 and showing guide bars having hexagonal shape with double primes added to reference numerals.

The tow-guiding mechanism 4 includes two guide bars 5 that are common to all of the tows 1, and have a quadratic cross-sectional shape. The three tows 1 are guided together about the guide bars 5 in an S-shaped manner. Three curved guide members 6 follow the two guide bars 5. To the sides, each of these guide members 6 is provided with upwardly directed bends 7 that form a guide bed 8 for the tows 1, with each individual one of the three tows 1 being disposed in a guide bed 8 of the curved guide members 6. The latter are secured to sleeves 9 that in turn are displaceable upon bars 10 transverse to the direction of feed of the tows 1.

Figure 3:
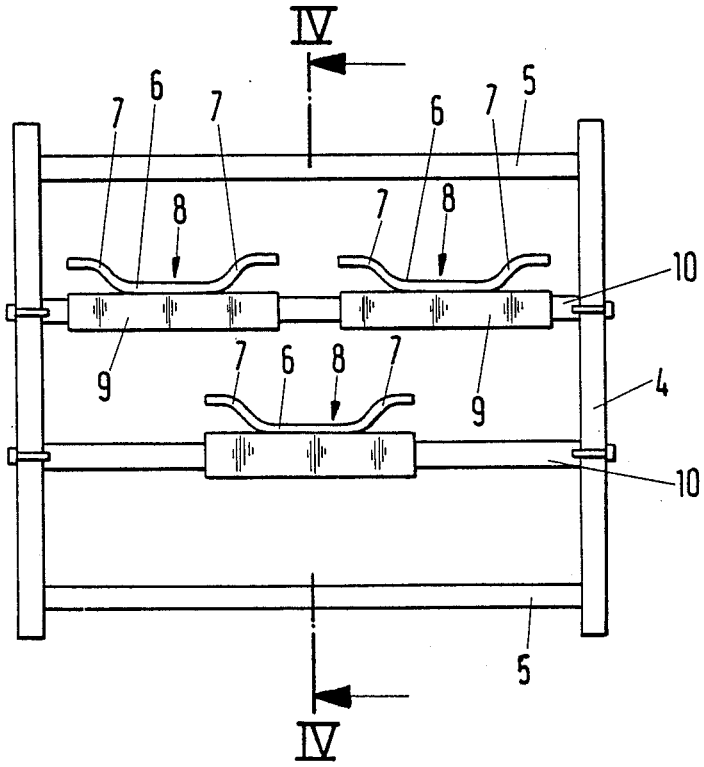
FIG. 3 is a view, taken in the direction of the feed path of the tow, of the tow-guiding mechanism of the drafting frame of the inventive stretch-break machine.

From the arrangement of the curved guide members 6 illustrated in FIG. 3, it can be seen that a total of three such curved guide members 6 are provided, with the lower curved guide member 6 being disposed in the space between the two upper curved guide members 6, so that the three withdrawn tows 1 are fed through the drafting frame 3 next to one another. If, for example, instead of the illustrated arrangement four tows 1 are to be fed to the stretch-breaking machine, it is conceivable to provide the tow-guiding mechanisms 4 with two pairs of curved guide members, with the members of each pair being disposed one above the other, so that the tows are then guided not only next to one another but also above one another.

In order to be able to guide the three tows 1 that in the illustrated embodiment are guided next to one another via the three curved guide members 6 of the tow-guiding mechanism 4 in such a way that they are guided next to one another in essentially the same plane, and hence to further spread out the tows 1, the drafting frame 3 is provided with two pairs 11 of guide members, with each pair 11 being provided with guide members 11′ and 11″. The guide member 11′ of each pair 11 has a configuration similar to that of the curved guided members 6 of the tow-guiding mechanism 4, and its position is pivotable in the direction of the flow of the tow, for which purpose the guide member 11′ is disposed on an arm 12, the axis of rotation of which is disposed in the axis of the other guide member 11'' of the pair 11. To obtain a good spreading of the tows 1 with an overall high line weight, the guide members 11', 11'' can have a length of, for example, 600 mm.

The introduction of the tows 1 into the actual stretch-breaking machine is characterized by two guide members 13 that are solid due to the forces that occur. For a final adjustment of the spreading of the tows, a curved and rotatable further guide member 14 is associated with the guide members 13. After a repeated change of direction has taken place, the prestretched tow is fed to a three-high mill of rollers 15 that has an omega-shaped loop-around. The rolling mill 15 comprises two driven lower cylinders and a hydraulically loaded pressure roller.

Following the rolling mill 15 is a distortion and heating zone I that has a heating device 16 in which the tow 1 is stretched in the thermoplastically warm or cold state, yet is not broken. With a view toward the desired ability of the fibers to shrink, different stretch values and temperatures that are specific to the material are set. This distortion and heating zone I forms the upper level E1 for the processing in the stretch-break machine.

In order to deflect the tow 1 into the lower processing level (level E2), the tow 1 is guided over the cylinder 17 and is then deflected into the opposite processing direction via a feed group that comprises two cylinders 18 and an associated pressure roller 19, with the latter assuring a jerk-free processing when the machine is started.

The cylinders 18 form the beginning of the preliminary breaking zone II of the lower level E2. When viewed in the direction of feed, on the upstream side the preliminary breaking zone II is delimited by further cylinders 20 and the associated pressure roller 21. In this preliminary breaking zone II, the majority of the fibers are broken, with a nearly normal distribution of fiber lengths between a few millimeters and the length of the preliminary breaking zone II occurring. The length of this zone II is expediently at least 500 mm. The length selected for the zone is optimally obtained by taking into consideration the breaking forces, which are reduced as the length of the zone increases in conjunction with lower required forces in the region of the rollers that delimit the zone II, and also taking into consideration the better operating conditions, especially the avoidance of floc breaks, which are obtained with shorter zones. Due to the high transmittable forces at the end of the preliminary breaking zone II, the embodiment of the four-high mill of rollers (the drive cylinders 20 and the cylinders 20') that form the conclusion of this zone II, along with the associated hydraulically loaded pressure roller 21, play a central role. Varying tensions from the preliminary breaking zone II are thus not transmitted on to the following preliminary breaking zone III.

As a result of the fiber sliver line weight being lower due to distortion, and as a result of the already effected breaking process, the preliminary breaking zone III is considerably shorter than the preliminary breaking zone III is expediently at least 200 mm, and at most 1000 mm. Guiding the fiber slivers at an angle relative to the processing direction permits a greater looping around the cylinders 20 for higher transmittable frictional forces.

Following the preliminary breaking zone III are two breaking zones IV and V; these zones are delimited by three rolling mills 22, each of which comprises two cylinders with an associated pressure roller. The lengths of the breaking zones IV and V, as well as the respective distortions, serve on the one hand to set the average fiber length, and serve on the other hand to set the variations in fiber length, which is characterized by the coefficients of variation CV %.

Whereas by setting the distortion and breaking zone lengths in the breaking zone IV predominantly the average fiber length is influenced, by setting the processing conditions in the breaking zone V especially the fiber length distribution can be influenced by eliminating overly long fibers. For this purpose, in the breaking zone V distortions that are at least twice as great as those in the breaking zone IV are utilized.

After leaving the rolling mills 22, the fiber sliver, possibly after passing through a sliver entwining mechanism 23, is fed via feed rollers 24 to a steaming device 25. Via a cooling conveyer belt 26 with which is connected a fan 27, the fiber sliver passes into a canister 28. These components form a delivery mechanism 29 for the stretch-break machine.

Figure 2:
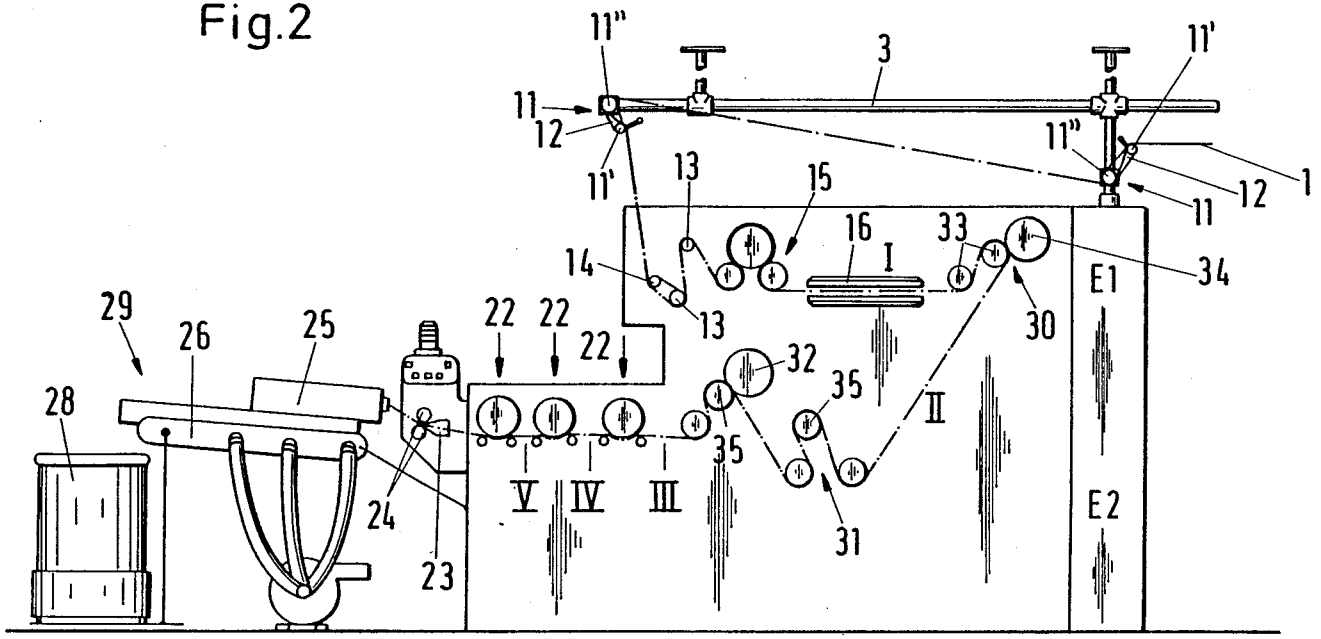
FIG. 2 is a side view of a second exemplary embodiment of the inventive stretch-break machine.

The embodiment of the stretch-break machine illustrated in FIG. 2 differs from the embodiment of FIG. 1 in that between the upper level E1 and the lower level E2, the first preliminary breaking zone II does not extend horizontally, but rather is inclined downwardly essentially vertically. This first preliminary breaking zone II is defined in the upper level E1 by a roller group 30 comprising drive cylinders 33 and a pressure roller 34, and is defined in the lower level E2 by a roller group 31 that comprises, among other things, drive cylinders 35 and a pressure roller 32. To avoid the formation of laps, the pressure roller 32 is tangential to only one of the lower cylinders (drive cylinders 35) of the roller group 31.

The inventive embodiment of the stretch-breaking machine illustrated in FIG. 2 is also provided with a tow-guiding mechanism 4 similar to that illustrated in FIG. 1. However, for the sake of facilitating illustration, this mechanism is not shown in FIG. 2.

Although not illustrated, it would also be possible to provide a stretch-break machine where the first preliminary breaking zone II is disposed in a separate level between the lower level E2 and the upper level E1.

As a result of the inventive configuration, higher pressure roller pressures can be applied in the distortion and breaking zones, and the tows or slivers can be guided through the processing elements over a greater width than was previously possible. Tests that have been undertaken have shown that a combination effect is surprisingly obtained that makes it possible to process, free of disruption, tow weights in the range of 120 to 240 ktex for a filament fineness of 3.3 dtex, and possibly even greater tow weights, without having to sacrifice a compact construction of the stretch-break machine.

The stretch-break converting machine of the present invention is characterized primarily in that the drafting mechanism, in order to be able to process tows having a high line weight, is spread out such that a plurality of separate tows can be individually guided parallel to and independently of one another next to and/or above one another, and in that the width of the components of the distortion and breaking zones is greater than 270 mm as measured transverse to the feed direction of the tow.

The inventive stretch-break machine has the advantage that the tows or slivers can be guided over a greater width through the processing components of the distortion and breaking zones without disrupting the process sequence with floc or bundle breakage or the formation of laps. As a result, it is possible to process, free of disruption, correspondingly greater overall tow weights, so that in principle the possibility is also presented for being able to simultaneously process a plurality of tows of lesser weight. In so doing, greater pressure roller pressures in the distortion and breaking zones can be utilized.

Thus, the inventive stretch-break machine makes it possible, for example, to feed to the tow-drafting mechanism, at a desired distance from one another, the tows withdrawn from three bales that are disposed adjacent one another. Viewed as a whole, with regard to the tow line weights that can be processed, there are no limitations with regard to using all currently known tows or any tows that might be foreseeable in the future. This is possible with the inventive stretch-break machine so that, depending upon the existing properties, one to four tows that are supplied parallel to one another and/or in layers can be processed, whereby a particular advantage of the inventively proposed stretch-break converting machine lies in the possibility, by varying the overall distortion, of being able to process, at a high production capacity, not only tows with an overall low quantity weight but also tows having an overall high quantity weight. This connection is merely necessary to note that pursuant to present day knowledge, with conventional stretch-break converting machines, a reduction of the distortion below a value of approximately 4.5 is possible only in exceptional cases. However, tests with the inventive stretch-break converting machine have shown that a reduction of the distortion at low tow quantity weight is possible, resulting in a corresponding increase in the output capacity.

Following the distortion zone of a stretch-break machine is a first breaking zone, the so-called preliminary breaking zone. Pursuant to the present invention, this preliminary breaking zone is advantageously delimited by two working cylinders with an associated upper pressure roller, with the length of this zone being greater than 500 mm. In this way, the majority of the fibers are broken in the preliminary breaking zone, with a nearly normal distribution of fiber lengths between several millimeters and the length of the preliminary breaking zone occurring. The selected length of the zone is optimally obtained taking into consideration the breaking forces that are reduced as the length of the zone increases, in conjunction with the lower pressures that are required in the region of the rollers that delimit the preliminary breaking zone, and also taking into consideration the better operating conditions, especially the avoidance of floc breakage, that is obtained in a shorter zone length.

By disposing the pressure roller above the working rollers, and by using only two working cylinders, a particularly compact arrangement is achieved. The pressure roller is hydraulically loaded. This inventive embodiment plays a central role due to the high transmittable tensions at the end of the preliminary breaking zone. Varying tensions are not transferred from the preliminary breaking zone to the subsequent breaking zones. In this connection, it can be advantageous to guide the fiber slivers at an angle, relative to the processing direction, between the preliminary breaking zones and the further breaking zones, in order to effect a greater looping around the drive cylinders to thereby assure greater transferable frictional forces.

To make it possible to adapt the machine size to existing installation conditions, it can be advantageous to dispose at least one distortion and/or breaking zone vertically. In so doing, the vertical zone can advantageously be defined both at the top and at the bottom by roller groups, with both of which, in order to avoid deformation of laps, the pressure roller is tangential to only one of the lower cylinders. It should be noted that the term "vertical" is in this context used to also include an inclined guidance of the tow between two levels.

In principle, the tow-drafting mechanism of the inventive stretch-break machine can be fed from any desired direction.

The tow-guiding mechanism includes individual curved guide members that extend transverse to the feed direction of the tow, and that each form, for the tow, a guide bed that is delimited at both sides by the bends of the guide member. Thus it is possible in a technically straightforward manner to precisely guide the tows and feed them to the distortion and breaking zones. In particular, it is readily possible to integrate such a tow-guiding mechanism into conventional stretch-break converting machines without requiring an additional capital outlay, and without thereby sacrificing the compactness of the heretofore known stretch-break converting machines.

Furthermore, prior to or in other words upstream of the curved guide members, the tows can be deflected or guided about guide bars that are common to all of the tows. In cooperation with the curved guide members, an optimum guidance of the tows is provided, with the common guide bars generating a tension in the tows that has a positive effect upon the character of the guidance.

The common guide bars preferably have a polygonal cross-sectional shape, which can, for example, be triangular, quadratic, or hexagonal.

Furthermore, after or in other words downstream of the tow-guiding mechanism on the drafting frame, at least one pair of guide members is disposed, with one guide member thereof being curved and forming, for the tows, a guide bed that is delimited at the sides by the bends of the guide member, and that combines the tows next to and/or above one another. Via the pair of guide members, it is possible to guide the tows in a planar manner next to or above one another, and in so doing to further spread them. In order to further improve such a spreading, it is finally set forth that the curved guide member of the pair of guide members can be pivotable in its position relative to the tow flow.

The present invention is, of course, in no way restricted to the specific disclosure of the specification and drawings, but also encompasses any modifications within the scope of the appended claims.

What I claim is:

1. In a machine for stretch-break converting man-made fibers or fiber slivers, with said machine having one or more distortion zones, one of which can be embodied as a heating zone, and one or more breaking zones, whereby said distortion and breaking zones can be disposed in several superimposed levels, and with said machine also having a tow-drafting mechanism, as well as a delivery mechanism for the stretch-break converted fiber slivers, the improvement therewith comprising:

said tow-drafting mechanism, in order to be able to process tows having a high line weight, is spread out such that a plurality of separate tows can be individually guided parallel to and independently of one another next to and/or above one another;

means for determination of width of said distortion and breaking zones, as measured transverse to a direction of feed, which width is greater than 270 mm; and said distortion and breaking zones being disposed in two superimposed levels, with said tows of one level being guided in a direction opposite to the direction in which they are guided in the other level, with the upper one of said two levels being provided with a distortion zone and being supplied with tows, and with the lower one of said levels being provided with breaking zones.

2. A machine according to claim 1, in which means introduce the tows to said distortion zone so that preliminarily multiple deflection of said tows occurs and subsequently therewith via a rolling mill that has an omega-shaped loop-around and comprises two driven cylinders and thereabove a pressure roller.

3. A machine according to claim 1, which includes a feed group to guide said tows from said upper level to said lower level, with said feed group comprising two drive cylinders and a pressure roller that cooperates with only one of said drive cylinders.

4. A machine according to claim 1, in which a first breaking zone, in the form of a preliminary breaking zone, follows said distortion zone and includes two drive cylinders and thereabove a pressure roller, with the length of said preliminary breaking zone being greater than 500 mm.

5. A machine according to claim 4, in which between said preliminary breaking zone and the remainder of said breaking zones, said tows are guided at an angle relative to a direction of processing.

6. A machine according to claim 4, in which a second breaking zone having a length of from 200 to 1000 mm is disposed downstream of said preliminary breaking zone, with a third and fourth breaking zone being disposed consecutively downstream of said second breaking zone, whereby distortion of said tows in said fourth and final breaking zone being at least twice as great as in said third breaking zone.

7. A machine according to claim 1, in which at least one of said distortion and breaking zones is disposed essentially vertically of each other.

8. A machine according to claim 7, in which at both a top and a bottom of said vertical zone there is disposed a respective roller group, each of which comprises cylinders and thereabove a pressure roller that is tangential to only one of said cylinders.

9. A machine according to claim 1, in which supply of said tow to said upper level is effected via said tow-drafting mechanism which is in the form of a drafting frame in which said tow is guided in a direction opposite to the direction in which said tow is guided in said upper level.

10. A machine according to claim 9, in which said drafting frame, at the beginning of a tow-feed path therethrough, is provided with a tow-guiding mechanism via which a plurality of separate tows can be individually guided parallel to and independently of one another relative, next to and/or above one another to said distortion and breaking zones.

11. A machine according to claim 10, in which said tow-guiding mechanism comprises individual curved guide members that extend transverse to the direction of feed of said tows, with each guide member forming for a tow a guide bed that is delimited at the sides by bends.

12. A machine according to claim 11, in which each of said curved guide members is shiftable in a direction transverse to the direction of feed of said tows.

13. A machine according to claim 11, which includes, upstream of said curved guide members, guide bars about which all of said tows are deflected together.

14. A machine according to claim 13, in which each of said guide bars has a polygonal cross-section shape.

15. A machine according to claim 14, in which each of said bars has a triangular cross-sectional shape.

16. A machine according to claim 14, in which each of said guide bars has a quadratic cross-sectional shape.

17. A machine according to claim 14, in which each of said guide bars has a hexagonal cross-sectional shape.

18. A machine according to claim 10, which includes at least one pair of guide members disposed downstream of said tow-guiding mechanism on said drafting frame; one of said guide members is curved and forms for said tows a guide bed that is delimited at the sides by bends and that guides said tows next to and/or above one another.

19. A machine according to claim 18, in which said one curved guide member of said pair of guide members is pivotable in its position relative to the tow feed.

* * * * *